US008683715B1

(12) United States Patent
Cantrell et al.

(10) Patent No.: US 8,683,715 B1
(45) Date of Patent: Apr. 1, 2014

(54) ELASTIC BOOT CUFF

(76) Inventors: Robbin Cantrell, Hackett, AR (US); William Cantrell, Hackett, AR (US)

( * ) Notice: Subject to any disclaimer, the term of this patent is extended or adjusted under 35 U.S.C. 154(b) by 520 days.

(21) Appl. No.: 12/750,481

(22) Filed: Mar. 30, 2010

(51) Int. Cl.

| | |
|---|---|
| ***A41D 17/00*** | (2006.01) |
| ***A43B 23/24*** | (2006.01) |
| ***A43B 3/00*** | (2006.01) |
| ***A43B 3/02*** | (2006.01) |
| ***A43B 3/04*** | (2006.01) |

(52) U.S. Cl.
CPC ..... *A41D 17/00* (2013.01); *A43B 3/0031* (2013.01); *A43B 3/0078* (2013.01); *A43B 3/02* (2013.01); *A43B 23/24* (2013.01); *A43B 3/04* (2013.01)
USPC ..... 36/2 R; 36/136

(58) Field of Classification Search
CPC .... A41D 17/00; A43B 3/0031; A43B 3/0078; A43B 3/02; A43B 3/04; A43B 23/24
USPC ..... 36/2 R, 136, 1.5
See application file for complete search history.

(56) References Cited

U.S. PATENT DOCUMENTS

| | | | | |
|---|---|---|---|---|
| 197,868 | A | 12/1877 | Langford | |
| 743,625 | A | 11/1903 | Douglas | |
| 1,715,147 | A * | 5/1929 | Porr | 36/7.3 |
| 1,746,485 | A | 2/1930 | Lynk | |
| 2,105,335 | A * | 1/1938 | Smiley | 36/7.3 |
| 2,597,285 | A * | 5/1952 | Brown | 428/88 |
| 2,729,899 | A * | 1/1956 | Haase | 36/7.1 R |
| 2,857,688 | A * | 10/1958 | Haase | 36/1 |
| 3,238,537 | A | 3/1966 | Fowler et al. | |
| 3,435,544 | A * | 4/1969 | Lish | 36/2 R |
| 4,517,685 | A | 5/1985 | Lesley | |
| 4,675,915 | A | 6/1987 | Siciliano | |
| 5,143,762 | A * | 9/1992 | Ho | 428/35.7 |
| 5,758,671 | A | 6/1998 | Thim | |
| 6,000,408 | A | 12/1999 | Maturaporn | |
| 6,209,141 | B1 | 4/2001 | Adeli | |
| 2010/0132226 | A1 * | 6/2010 | Mehl et al. | 36/136 |
| 2012/0174442 | A1 * | 7/2012 | Castle | 36/136 |

FOREIGN PATENT DOCUMENTS

| | | |
|---|---|---|
| CN | 201178715 | 1/2009 |
| FR | 2606604 | 5/1988 |
| NL | 1017249 | 5/2001 |

* cited by examiner

*Primary Examiner* — Ted Kavanaugh
(74) *Attorney, Agent, or Firm* — Michael I. Kroll

(57) ABSTRACT

A decorative article for boots comprising a cuff manufactured from either a length of material or elastic material having fur, feathers or other decorative articles fastened thereto. An interior pocket is included for storage of money, credit cards, I.D. warmers, coins and the like.

5 Claims, 13 Drawing Sheets

ELASTIC BOOT CUFF

BACKGROUND OF THE INVENTION

1. Field of the Invention

The present invention relates generally to apparel and, more specifically, to a decorative article for boots comprising a cuff manufactured from either a length of fabric material or elastic material having fur, feathers or other decorative articles fastened thereto.

The present invention further provides that dissimilar width of elastic can be used to bind the boot cuff to a boot where the top larger width is sewn along its top edge with it bottom edge simply tack, such as sewn, on opposing sides so that the bottom edge will form an ovoid for use with boots having a contoured top. Additionally the present invention provides for looping the exterior back into the interior making the boot cuff reversible.

2. Description of the Prior Art

There are other boot cuffs designed for placement over a boot. Typical of these is U.S. Pat. No. 197,868 issued to Langford on Dec. 4, 1877.

Another patent was issued to Douglas on Nov. 10, 1903 as U.S. Pat. No. 743,625. Yet another U.S. Pat. No. 1,746,485 was issued to Lynk on Feb. 11, 1930 and still yet another was issued on Mar. 8, 1966 to Fowler et al. as U.S. Pat. No. 3,238,537.

Another patent was issued to Lesley on May 21, 1985 as U.S. Pat. No. 4,517,685. Yet another U.S. Pat. No. 4,675,915 was issued to Siciliano on Jun. 30, 1987. Another was issued to Thim on Jun. 2, 1998 as U.S. Pat. No. 5,758,671 and still yet another was issued on Dec. 14, 1999 to Maturaporn as U.S. Pat. No. 6,000,408.

Another patent was issued to Adeli on Apr. 3, 2001 as U.S. Pat. No. 6,209,141. Yet another French Patent No. FR2606604 was issued to Letard on May 20, 1988. Another was issued to Wolters on May 4, 2001 as Netherlands Patent No. NL1017249 and still yet another was issued on Jan. 14, 2009 to Daping as Chinese Patent No. CN201178715.

U.S. Pat. No. 197,868

Inventor: Charles F. Langford

Issued: Dec. 4, 1877

As a new article of manufacture, a knee-protector, consisting of a tube of textile material, with ribbed ends and intermediate portion made larger in circumference than the ends, as herein set forth and described.

U.S. Pat. No. 743,625

Inventor: Elizabeth M. Douglas

Issued: Nov. 10, 1903

The combination of a straight elastic body portion open at both ends, an enlarged and thickened portion at one end, a contracting portion adjacent thereto; and a longitudinal slit in the back adjacent to the other end.

U.S. Pat. No. 1,746,485

Inventor: Zella Lynk

Issued: Feb. 11, 1930

A protector for the ankles, comprising a fabric band provided adjacent to its lower edge with a longitudinal hem and near its longitudinal center with an upper longitudinal hem, the band projecting upwardly beyond the upper hem in the form of a split cuff having a considerable width, elastic bands held within the hems and attached at their ends to the ends of the fabric band gathered, and snap fasteners embodying elements secured to the ends of the elastic bands.

U.S. Pat. No. 3,238,537

Inventor: Hilda Abrevaya Fowler

Issued: Mar. 8, 1966

An ankle warmer comprising an elongated flexible strip of material convexly contoured throughout its length and having an inturned end, the convex contouring approximating the contour of the human ankle; a lining extending along the interior surface of said strip of material and secured thereto; a rigid insert sandwiched between said inturned end and said strip; said insert being convexly contoured and arranged at one end of said strip; a plurality of spaced fastening members secured to the inturned end of said strip over said insert; and extending above the plane of said lining; and an anchoring member on the other end on the outer surface of said elongate strip of material, said anchoring member having cooperating portions for engagement with any one of said fastening members.

U.S. Pat. No. 4,517,685

Inventor: Gary M. Lesley

Issued: May 21, 1985

Retro-reflective material is secured to the exterior surface of an article of wearing apparel in a manner which maximizes the light-reflecting capability of the article. Specifically, the retro-reflective material is secured in a manner not requiring any add-on fasteners and which leaves the material ruffled or pleated. The invention increases the number of different surfaces available for gathering incident light rays and reflecting same back to the light source making the wearer more visible to the light source.

U.S. Pat. No. 4,675,915

Inventor: Anthony Siciliano

Issued: Jun. 30, 1987

The present invention relates to an article of wearing apparel, which is suitable for controlling body perspiration and eliminating the problems associated therewith.

U.S. Pat. No. 5,758,671

Inventor: Thoeum Thim

Issued: Jun. 2, 1998

A wearing accessory for use as a hair fastener, armband or legband and a method of making the same. The accessory includes an annular, flexible sleeve of cloth in which is provided a central annular pocket between outer portions. An annular flat elastic band is captured in the pocket with its wide dimension generally perpendicular to the radius of the band and sleeve but is allowed to move in the pocket. The accessory has an unstressed contracted condition wherein the sleeve is gathered circumferentially in closely bunched wrinkles along the pocket and is gathered in more widely spaced undulations or ruffles in the outer portions, and these undulations wind in a serpentine manner circumferentially of the accessory, partially or completely spiraling therearound, thereby creating a distinctive appearance. The accessory also has a stressed expanded conditions wherein the wrinkles and undulations remain, albeit each more widely spaced than in the unstressed condition.

U.S. Pat. No. 6,000,408

Inventor: Thawatchai Maturaporn

Published: Dec. 14, 1999

A tubular jersey and rib sewingless scrunchy includes a holding element and a sewingless tubular fabric coating wrapping around the holding elements, wherein the holding element is a loop shape fabric elastic band and the sewingless tubular fabric coating is made of a tubular jersey and rib material wrapping around the loop shape fabric elastic band, two ends of the sewingless tubular fabric coating being connected together by ultrasonic welding to form an endless body. Accordingly, since the tubular jersey and rib sewingless scrunchy of the present invention has no sewing line provided along the length of the fabric coating of the scrunchy, so that it is free of the risk of splitting or rending at such sewing line. Moreover, the improved structure of the scrunchy is adapted for mass production with minimum processing steps, wherein no sewing process is required to manufacture the scrunchy, that can largely save the production time and the production cost.

U.S. Pat. No. 6,209,141

Inventor: Pamela Adeli

Issued: Apr. 3, 2001

A pair of sock bands or covers to be used in conjunction with an ordinary pair of socks which are tubular-shaped and made of a woven elastic material which can be slid onto the top of a sock. The sock bands may include a fastener which is disposed around the inner surface of the sock band. The outer surface of each sock bands may contain indicia such as a logo or name of a team or organization.

France Patent Number FR2606604

Inventor: Michel Letard

Published: May 20, 1988

The garment leg or sleeve according to the invention has an inner muff 4 which is connected at its free end 3 in order to extend upwards inside the garment in order to enclose the ankle or wrist of the user at a level which will remain the same when the garment rises in the direction A following the movements of the user.

Netherland Patent Number NL1017249

Inventor: Franciscus Johannes Wolters

Published: May 4, 2001

The protective device comprises a muff with an elastic worn around the wrist.

China Patent Number CN201178715

Inventor: Wu Daping

Published: Jan. 14, 2009

The utility model provides a rainproof rain gear of a bicycle, which consists of a plastic thin film and a fastening elastic band. The rainproof rain gear is characterized in that a rainproof kneeboot made of the plastic film is sleeved at the ankle, a kneeboot sleeve opening is respectively provided with a circle of fastening elastic bands; the rainproof rain gear covers the undersole, the shoe surface and the trousers below the knee, has large rain-proof area, is not easy to loosen, has light and thin materials, is convenient to carry and use, and has low cost, and the transparent plastic film is utilized and the appearance of shoes is not affected. In rainy days, the rainproof rain gear is taken out and is sleeved on the common shoes so as to prevent rain from soaking the shoes when a person walks or rides a bicycle; in addition, the person can wear the prior shoes to walk. If no rain, the rainproof rain gear can be folded to carry. The product can be produced mechanically in mass, thereby realizing the line production and having low production cost and high efficiency.

While these cuffs may be suitable for the purposes for which they were designed, they would not be as suitable for the purposes of the present invention, as hereinafter described.

SUMMARY OF THE PRESENT INVENTION

A primary object of the present invention is to provide a flexible cuff for a boot.

Another object of the present invention is to provide a flexible cuff for a boot having an interior elastic band and an exterior fabric band.

Yet another object of the present invention is to provide a flexible cuff wherein said interior band is taken from the group of fabric material and elastic material.

Still yet another object of the present invention is to provide a flexible cuff wherein said exterior band is taken from the group of fabric material and elastic material.

An additional object of the present invention is to provide a flexible cuff wherein said exterior band has a decorative article attached thereto.

A further object of the present invention is to provide a flexible cuff wherein said decorative article is taken from the group of fur, feathers, elastic band, tassels and jewelry.

A yet further object of the present invention is to provide a flexible cuff wherein said exterior band is looped into the interior whereby said band is reversible.

A still yet further object of the present invention is to provide a flexible cuff wherein said interior band is a plurality of elastic bands.

An additional object of the present invention is to provide a flexible cuff wherein said plurality of interior elastic bands are of comparable width.

Another object of the present invention is to provide a flexible cuff wherein said plurality of interior elastic bands are of dissimilar width.

Yet another object of the present invention is to provide a flexible cuff wherein said interior band has a pocket sewn thereto for Warmers, Coins, etc.

Additional objects of the present invention will appear as the description proceeds.

The present invention overcomes the shortcomings of the prior art by providing The present invention relates generally to apparel and, more specifically, to a decorative article for boots comprising a cuff manufactured from either a length of material or elastic material having fur, feathers or other decorative articles fastened thereto.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
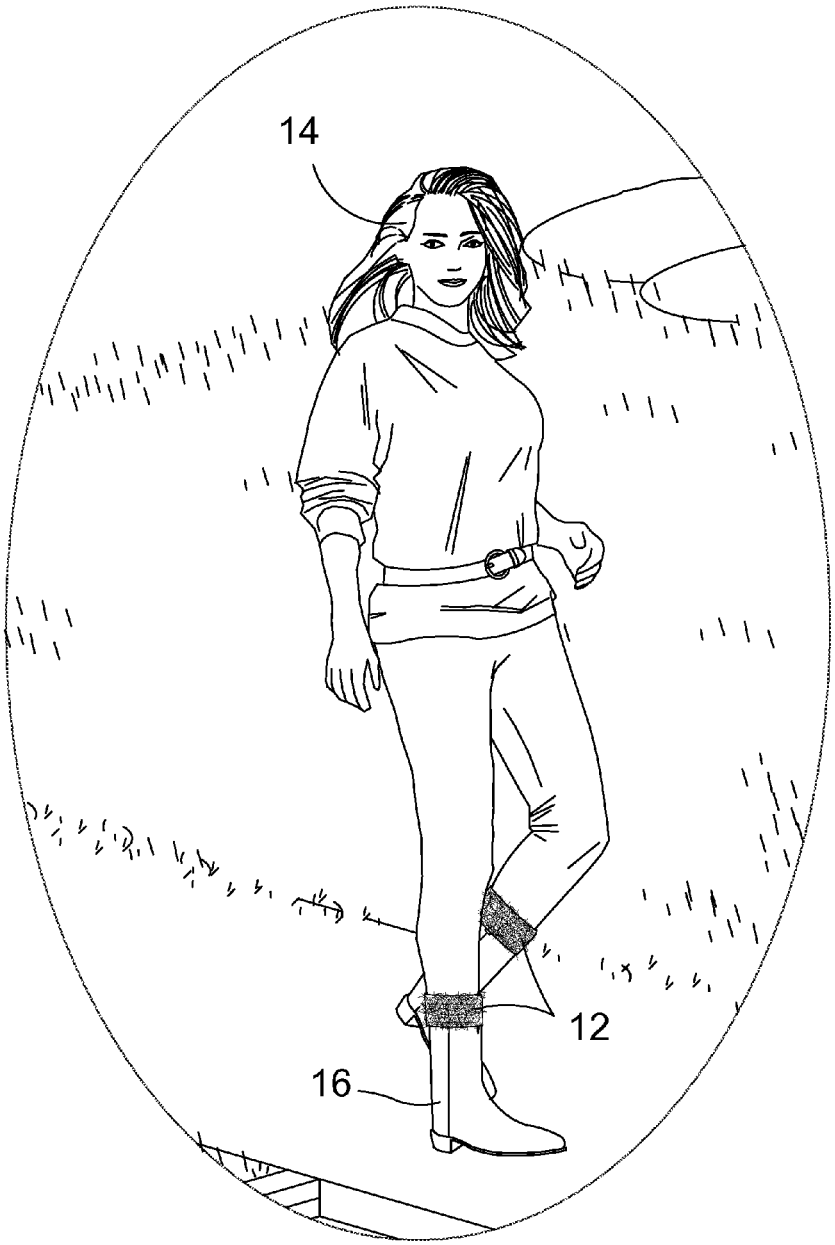
(PRIOR ART) FIG. 1
FIG. 1 is an illustrative view of the prior art.

Turning now descriptively to the drawings, in which similar reference characters denote similar elements throughout the several views, the figures illustrate the Decorative Elastic Boot Cuff of the present invention. With regard to the reference numerals used, the following numbering is used throughout the various drawing figures.

10 Decorative Elastic Boot Cuff of the present invention
12 prior art
14 user
16 boot
18 fur cuff
20 fabric material
22 fur
24 elastic band
26 top of 16
28 elastic retaining band
30 elastic backing
32 decorative article
34 interior side pocket
36 drawstring
38 ribbon
40 feather
42 elastic strap
44 loop
46 pant leg
48 decorative strip
50 tassel

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrated view of the prior art 12 in use. Shown is an illustrative view of the prior art 12 comprising a fur cuff having an elastic band sewn into a hem on each opening of said cuff that would require the cuff top edge to be placed on the user's 14 leg when used with a boot 16 having a contoured top opening.

Figure 2:
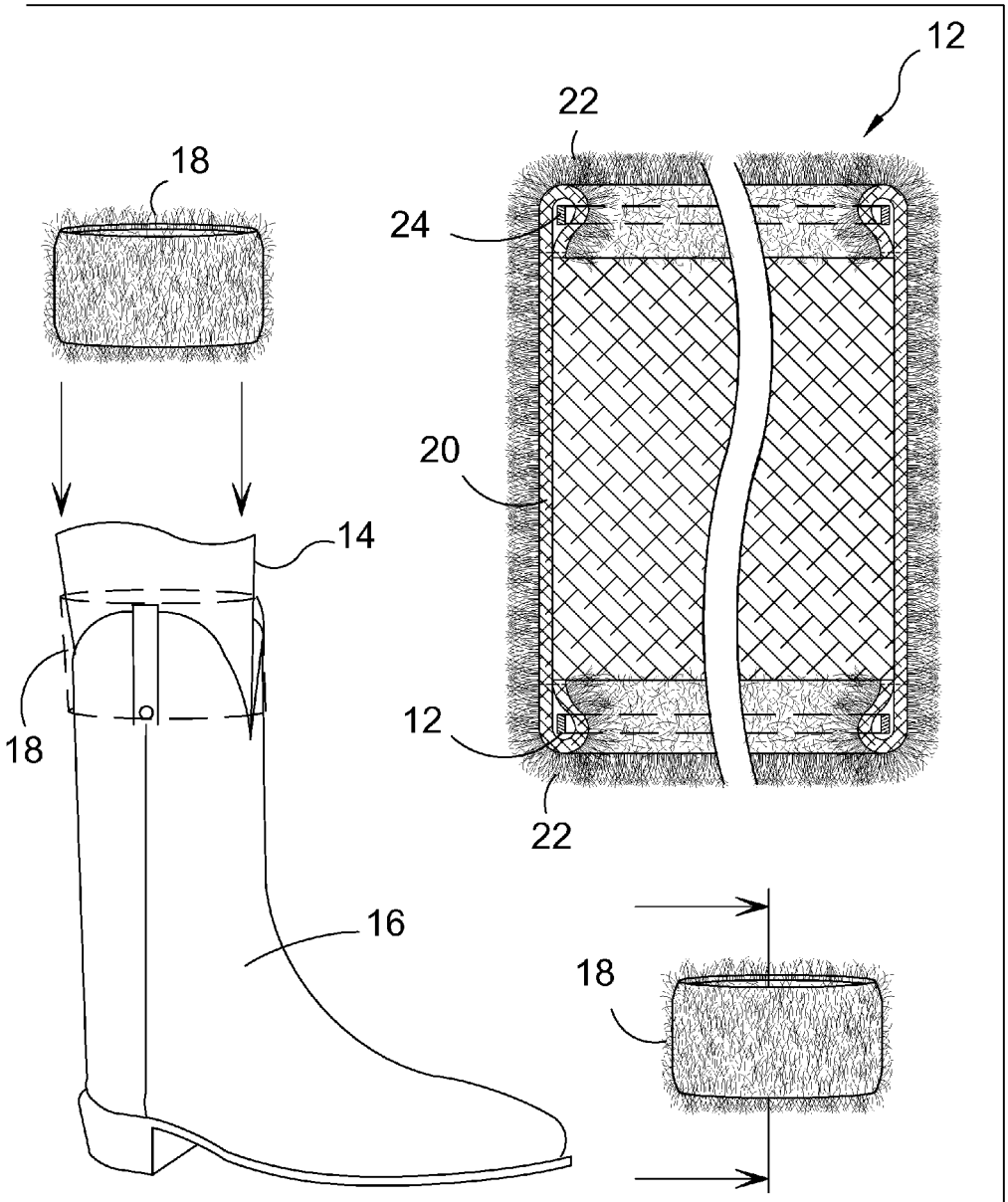
(PRIOR ART) FIG. 2
FIG. 2 is an illustrative view of the prior art in use.

FIG. 2 is an illustrated view of the prior art 12. The prior art 12 provides a boot cuff 18 mountable to a user boot 16 comprising a length of material 20 having fur 22 attached thereto. An elastic band 24 is sewn into a hem on each open end wherethen a user can place the cuff 18 on a boot 16. As illustrated, many women's boots have a curvilinear top edge requiring that the cuff 18 of the prior art to be placed on the user's leg 14 and then onto the boot 16 which may cause the cuff 18 to bunch at the top of the boot 16. The present invention provides an elastic strap that will hold the cuff to the top of the boot having a greater dimensional width than the prior art 12.

Figure 3:
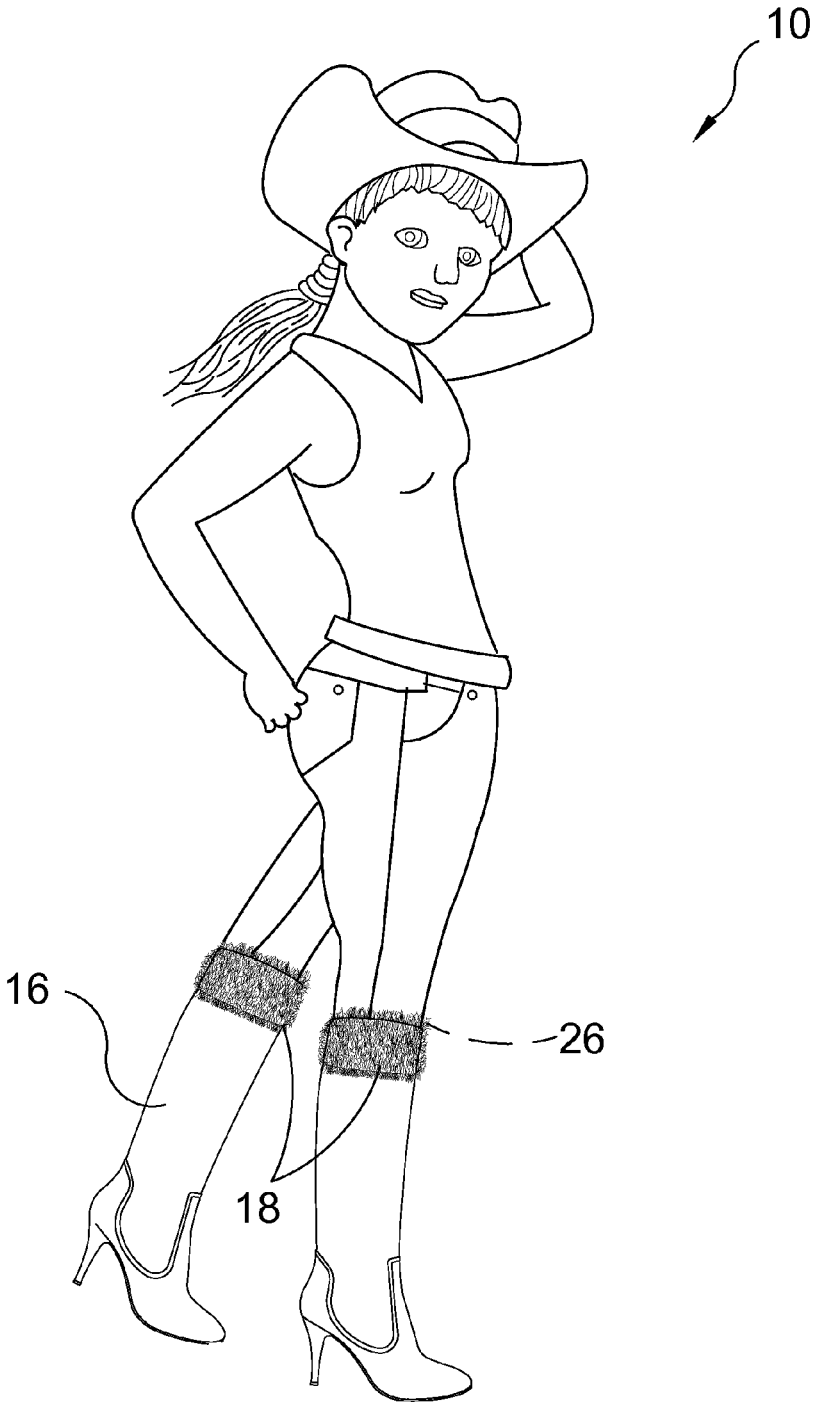
FIG. 3 is an illustrative view of the present invention.

FIG. 3 is an illustrative view of the present invention 10. Shown is the boot cuff 18 of the present invention in use, where a boot 16 having a linear or contoured top 26, as illustrated in FIG. 5, has the boot cuff 18 attached to the boot top 26.

Figure 4:
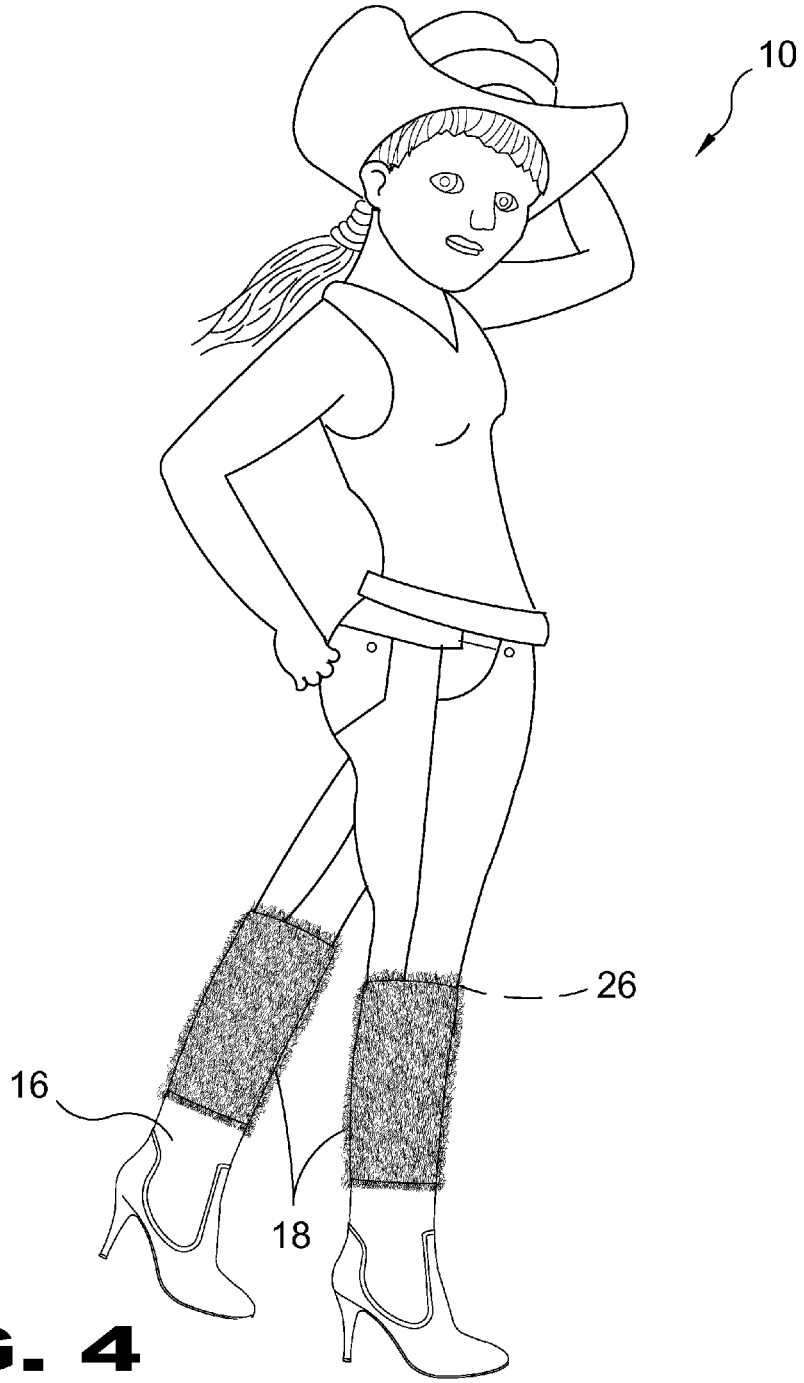
FIG. 4 is an illustrative view of the present invention.

FIG. 4 is an illustrated view of the present invention 10 in use. The boot 16 has a linear or contoured top 26, as illustrated in FIG. 5, has the boot cuff 18 attached to the boot 16 having a comparable full boot height.

Figure 5:
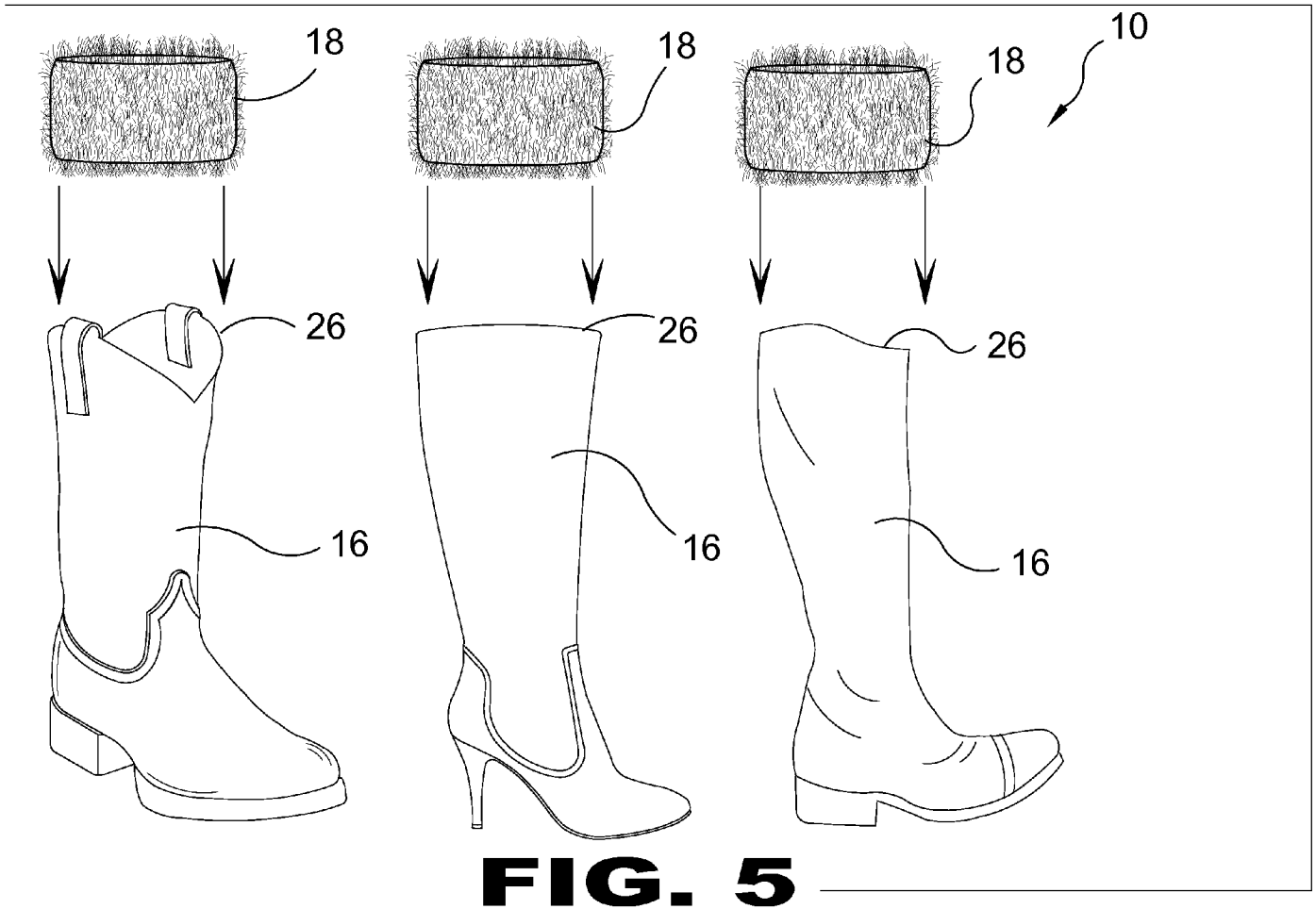
FIG. 5 is an illustrative view of women's boots.

FIG. 5 is an illustrated view of the present invention 10 employed with various women's boots 16. Illustrated are typical women's boots 16 that have a variety of boot openings from linear to contoured. The present invention 10 provides for the various boot tops 26 having a full elastic band as opposed to elastic strips positioned on the top and bottom of the cuff 18 as illustrated in the prior art.

Figure 6:
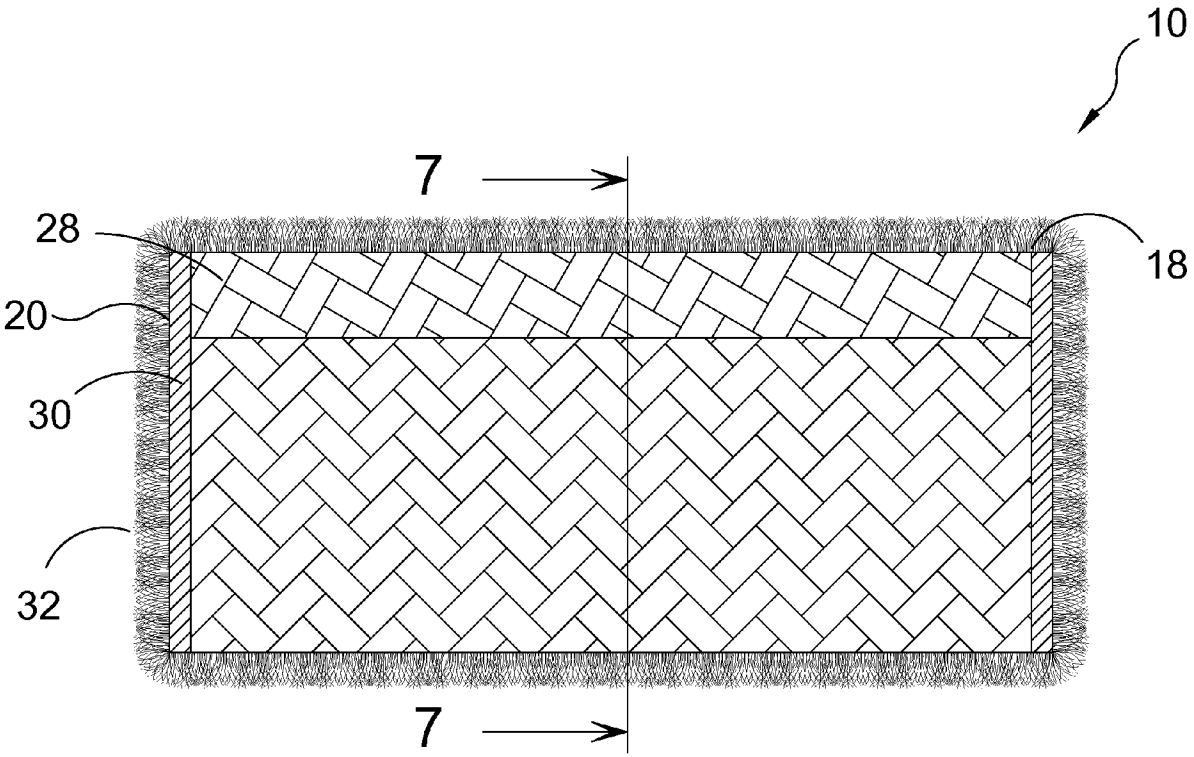
FIG. 6 is an illustrative view of the present invention.

FIG. 6 is a sectional view of the present invention 10. The present invention 10 provides a decorative article for boots comprising a cuff 18 manufactured from either a length of fabric material 20 and elastic backing 30 having fur, feathers or other decorative articles 32 fastened to the fabric material 20. The interior of the cuff 18 has a top side length with an elastic retainer band 28 that is fastened either adhesively or sewn along one longitudinal side leaving the other free thereby providing a strap that can be attached to the top lip of the boot or anywhere else as desired by the user.

Figure 7:
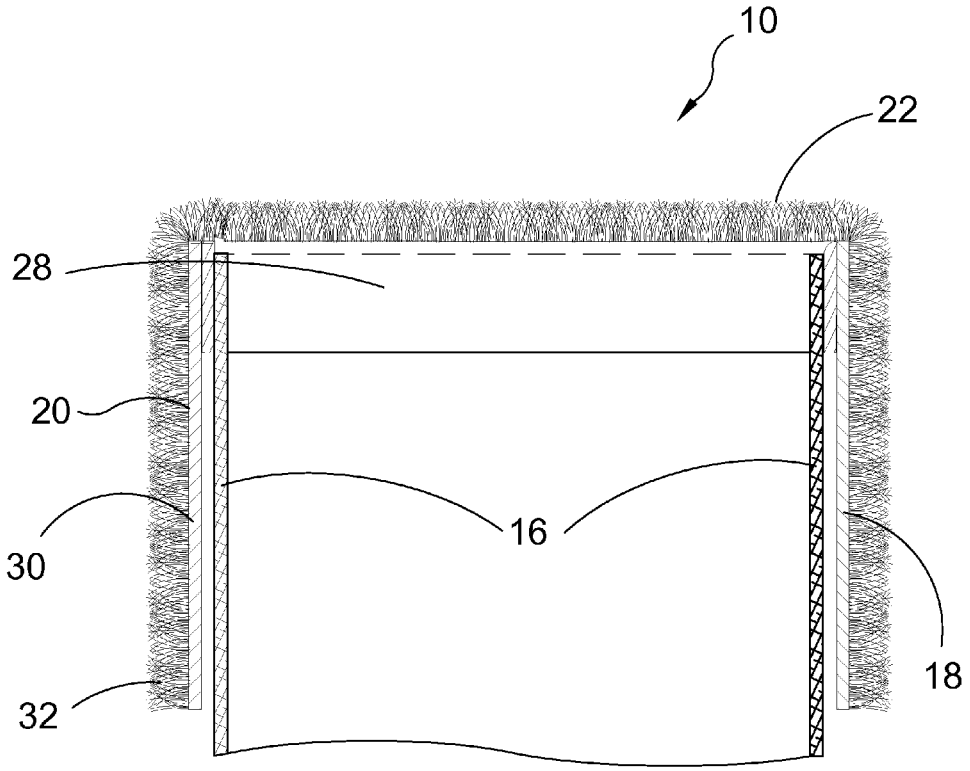
FIG. 7 is a sectional view of the present invention in use.

FIG. 7 is an illustrated view of the present invention 10. The present invention 10 provides a boot cuff 18 mountable to a user's boot 16 comprising a length of fabric material 20 bonded to an elastic backing 30 with fur or other decorative elements 32 such as fur 22 attached thereto. The interior of the cuff 18 has an elastic retainer band 28 fixedly attached along the top edge of the cuff 18 having its other longitudinal side free so that it can be attached to the top of a boot 16 or anywhere else as desired by the user. The advantage being that the elastic retainer band 28 allows the cuff 18 to be attached to a boot 16 having a curvilinear top edge by virtue of the elastic retainer band 28 having an appropriate dimensional width.

Figure 8:
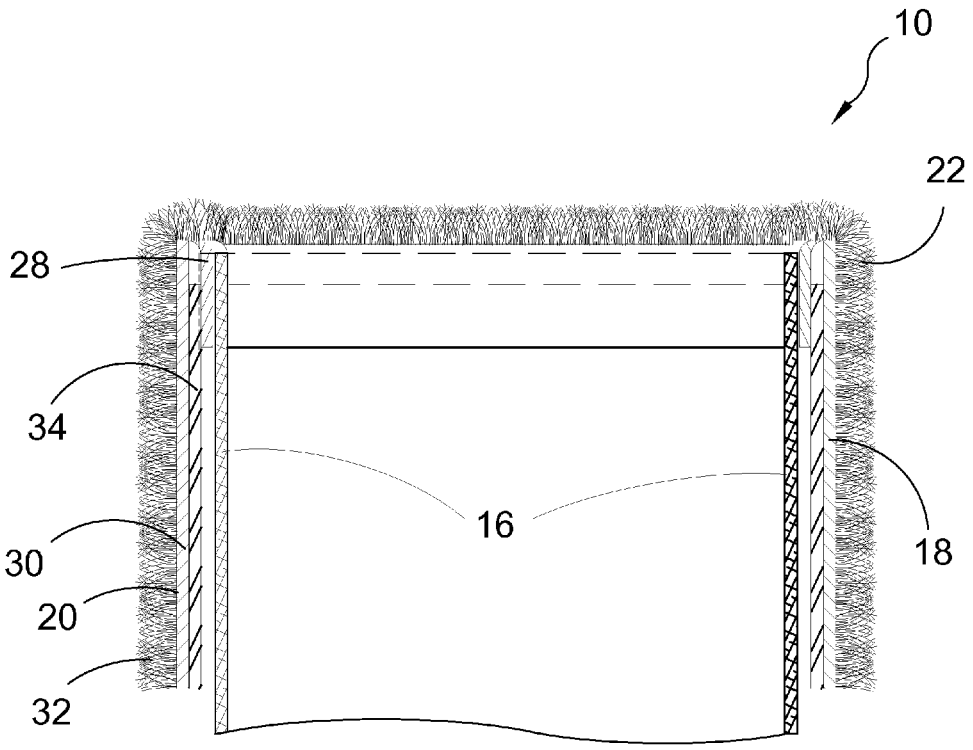
FIG. 8 is a sectional view of the present invention in use.

FIG. 8 is a sectional view of the present invention 10. As aforementioned, the present invention 10 provides a fur cuff 18 mountable to a user's boots 16 comprising a length of fabric material 20 and elastic backing 30 with fur 22 or other decorative elements 32 attached to the fabric material 20. The interior of the cuff 18 has an elastic retainer band 28 fixedly attached along the top edge of the cuff 18 having its other longitudinal side free so that it can be attached to the top of a boot 16 or anywhere else as desired by the user. The advantage being that the elastic retainer band 28 allows the cuff 18 to be attached to a boot 16 having a curvilinear top edge by virtue of the elastic strap having an appropriate dimensional width. Optionally provided is an interior side pocket 34 wherein a user may keep money, credit cards or other valuables.

Figure 9:
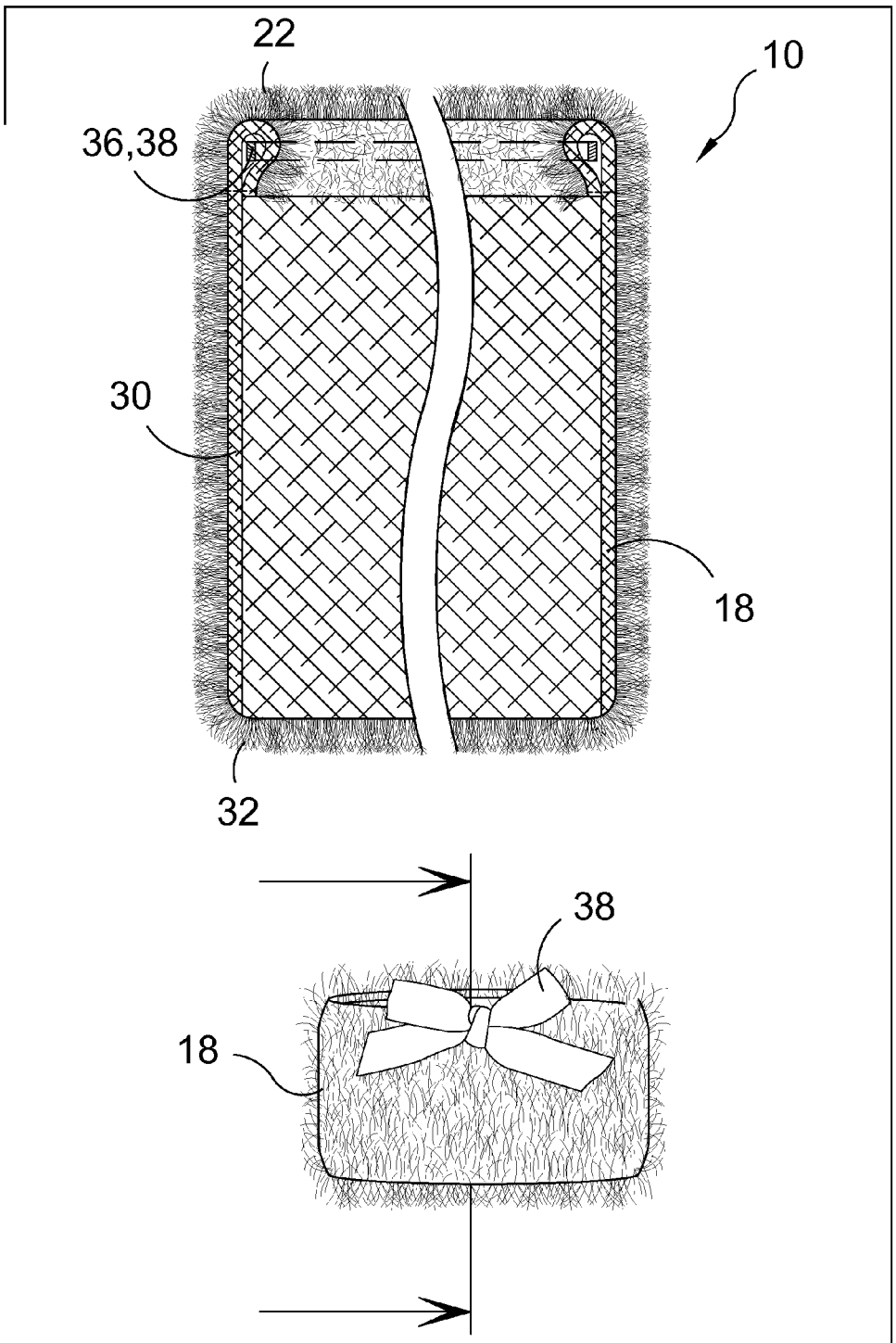
FIG. 9 is a sectional view of an additional element of the boot cuff.

FIG. 9 is a front and sectional view of an additional element of the present invention 10. The present invention 10 provides for an additional element wherein the boot cuff 18 having an elastic backing 30 with a decorative article 32 such as fur 22 attached to the fabric material 20 uses a drawstring 36 as closure to cinch the boot cuff 18 to a desired location on the boot. The drawstring 36 may be a ribbon 38 which cinches to the outside of the cuff or a cord that may be tied to the interior side of the cuff.

Figure 10:
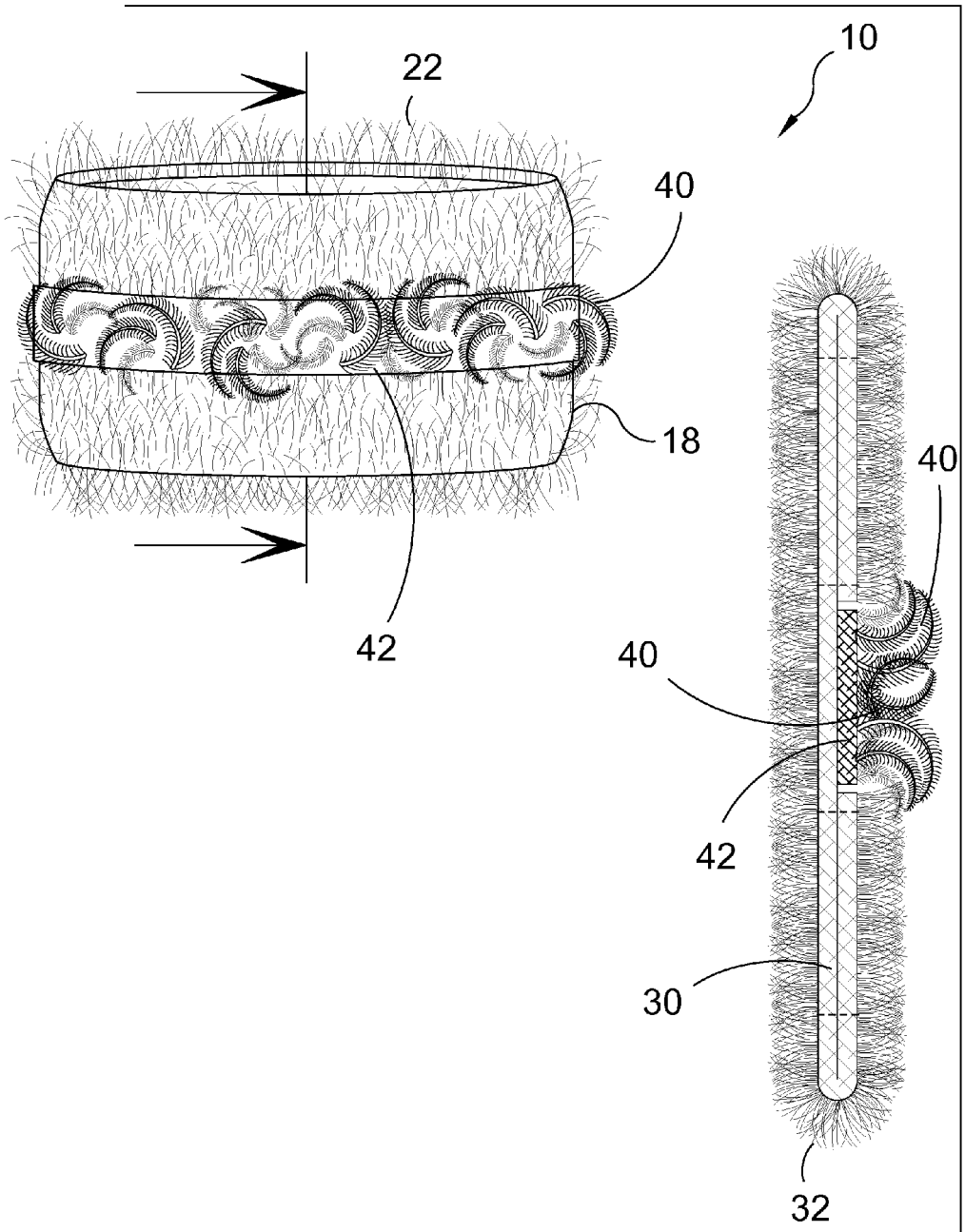
FIG. 10 is a sectional view of another additional element of the boot cuff.

FIG. 10 is a front and sectional view of another additional element of the present invention 10. The present invention 10 provides for an additional element wherein the boot cuff 18 has a decorative article 32 such as fur 22 including an elastic strap 42 with feathers 40 attached thereto.

Figure 11:
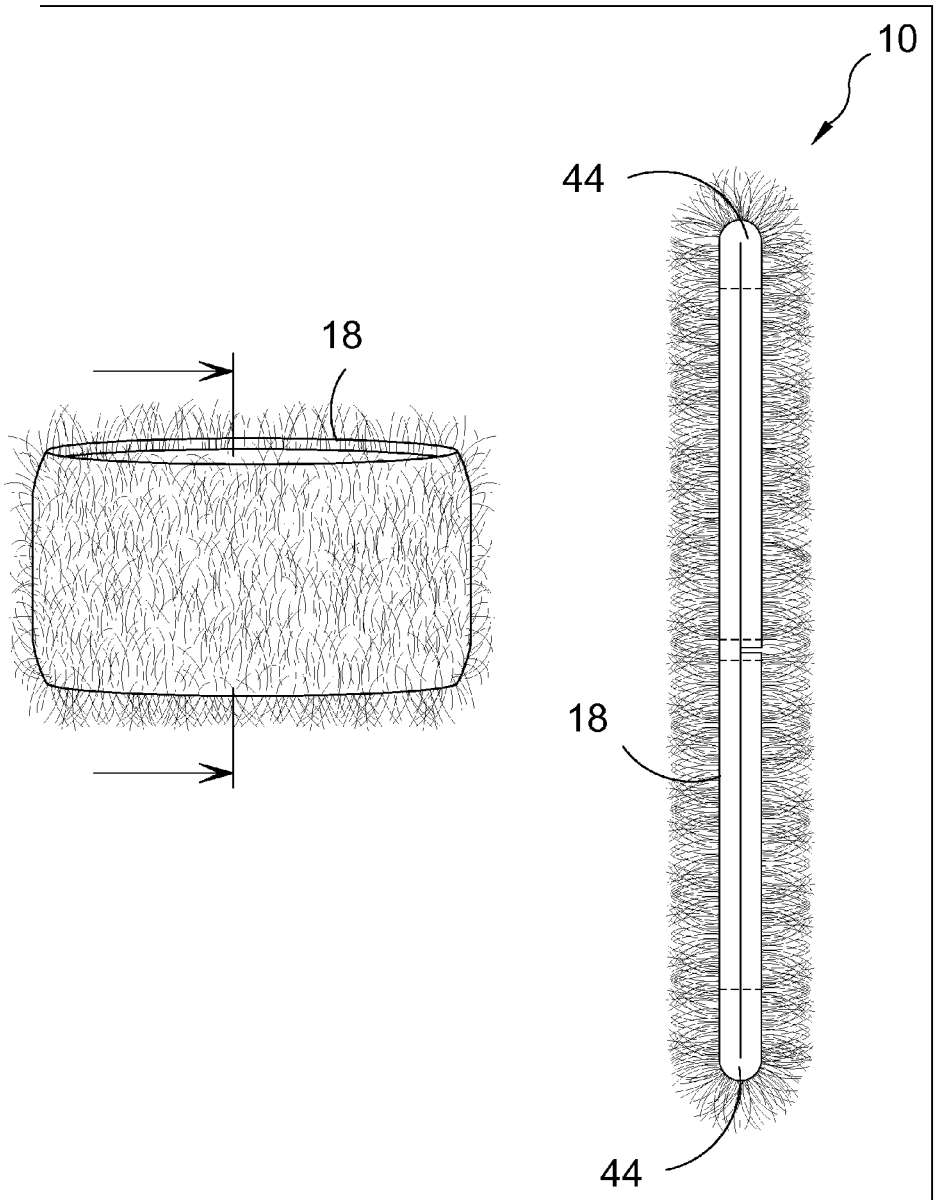
FIG. 11 is a sectional view of another additional element of the boot cuff.

FIG. 11 is a front and top view of another additional element of the present invention 10. The present invention 10 provides for another additional element wherein the boot cuff 18 is looped 44 back on both ends into the interior so that the boot cuff is reversible.

Figure 12:
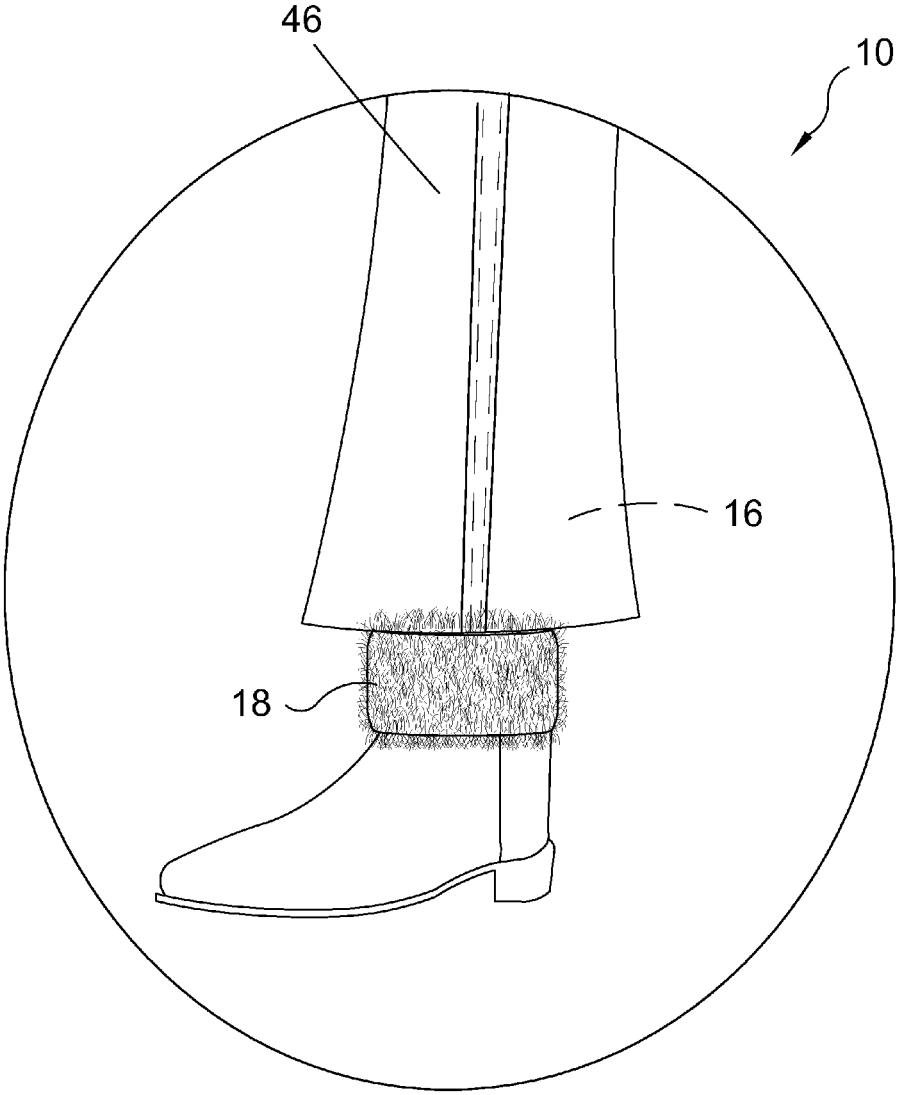
FIG. 12 is a side view of the present invention.

FIG. 12 is a side view of the present invention 10 in use. Shown is a side view of the decorative boot cuff 18 of the present invention installed on the bottom portion of the shaft of a boot 16 with the user's pants 46 over the boot.

Figure 13:
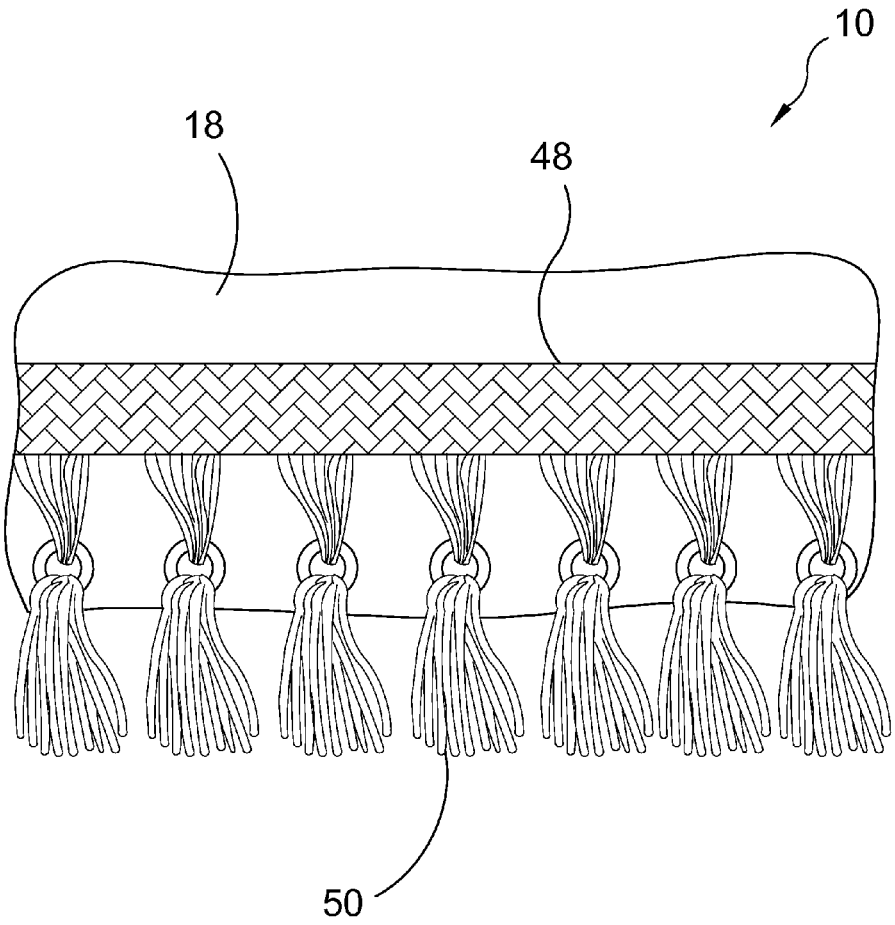
FIG. 13 is a side view of the present invention.

FIG. 13 is side view of the present invention 10. Shown is a side view of the decorative boot cuff 18 illustrating the versatility of possible styles, colors and patterns available to adorn it. Depicted is the boot cuff 18 with a decorative strip 48 and tassels 50.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A decorative, elastic boot cuff consisting of:

a) a substantially ring-like fabric material being unlooped at both upper and lower ends thereof;

b) an elastisized backing interiorly bonded to said fabric material extending from a top edge of said fabric material to a bottom edge of said fabric material;

c) an adornment decorative article exteriorly disposed on said fabric material;

d) a cinching fastening element comprising an elastic retaining band disposed inside of and only at a top portion of said cuff for gripping said boot only along said top portion, a top edge of said elastic retaining band being aligned with the top edge of said cuff, said elastic retaining band being on and attached directly to said elasticized backing between said elastic backing and said boot; and e) whereas said cuff is unattached to said boot below said retaining band.

2. The decorative, elastic boot cuff according to claim 1, wherein said decorative article is selected from the group consisting of fur, feathers, jewelry, ornaments, tassels and patterns.

3. The decorative, elastic boot cuff according to claim 2, wherein a top of said elastic retaining band is longitudinally sewn into the upper hem of said cuff.

4. The decorative, elastic boot cuff according to claim 3, wherein said cinching fastening element circumscribes an uppermost portion of said boot and said elastic backing clings to an immediate underlying area thereof.

5. The decorative, elastic boot cuff according to claim 1, wherein an elastic band is associated with said decorative articles.

* * * * *